US006823964B2

(12) United States Patent
Goode

(10) Patent No.: US 6,823,964 B2
(45) Date of Patent: Nov. 30, 2004

(54) FALL ARREST PLATFORM

(75) Inventor: Alexander George Nelson Goode, Ft. Loudon, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 253 days.

(21) Appl. No.: 10/145,808

(22) Filed: May 16, 2002

(65) Prior Publication Data

US 2002/0170783 A1 Nov. 21, 2002

Related U.S. Application Data

(60) Provisional application No. 60/291,313, filed on May 17, 2001.

(51) Int. Cl.[7] ..... A47L 3/04; A47L 3/02; E04G 1/18; E04G 1/00

(52) U.S. Cl. ..... 182/3; 182/141; 182/113; 182/2.1

(58) Field of Search ..... 182/3, 9, 4, 36, 182/5, 6, 141, 112, 113, 2.1–2.4, 2.5–2.9

(56) References Cited

U.S. PATENT DOCUMENTS 2,691,478 A 10/1954 Frankel
4,181,194 A 1/1980 Bassett et al.
4,243,118 A * 1/1981 Landry ..... 182/3
4,407,392 A 10/1983 Lazzari
4,560,029 A 12/1985 Dalmaso
4,705,140 A 11/1987 Dudley et al.
4,919,283 A 4/1990 Riley et al.
5,036,949 A 8/1991 Crocker et al.
5,092,426 A 3/1992 Rhodes
5,295,557 A * 3/1994 Taylor ..... 182/113
5,388,661 A 2/1995 Hood, Jr.
6,092,623 A 7/2000 Collavino
6,330,931 B1 * 12/2001 Baillargeon et al. ..... 182/3

* cited by examiner

*Primary Examiner*—Hugh B. Thompson, II
(74) *Attorney, Agent, or Firm*—Nixon & Vanderhye P.C.

(57) ABSTRACT

A fall arrest platform includes a platform cooperable with a lifting vehicle and having a floor, safety rails surrounding a perimeter of the floor, and an entrance gate in the side rails. A fall arrest system is integrated with the platform and includes a lanyard securable at one end to a user's harness, a lanyard connection securably receiving an opposite end of the lanyard, and mounting structure secured to the platform that supports the lanyard connection. The mounting structure movably supports the lanyard connection such that the user can move about a periphery of the platform. A compressed air accessory provides additional functionality and convenience. With this platform, a lift machine can be provided with the ability to access elevated surfaces and can also enable a safe work area outside of the machine platform.

11 Claims, 7 Drawing Sheets

FALL ARREST PLATFORM

CROSS-REFERENCES TO RELATED APPLICATIONS

This application claims the benefit of U.S. Provisional Patent Application Ser. No. 60/291,313, filed May 17, 2001, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The present invention relates to a new machine for accessing elevated surfaces that are inaccessible from inside a platform with fixed rails. Combining two technologies to create a machine with new capabilities produces this machine. These combined technologies are the aerial work platform and the fall arresting safety system. With this machine, a person will be able to use the aerial work platform capability to reach an elevated location and then use the safety of the fall arrest system to exit the platform and perform the required tasks.

When a worker cannot access the location of the work, the worker may unhook from the platform to access the work area. This situation is dangerous because the worker is not protected from a fall. The problem occurs when the platform cannot fit past some obstacle or the platform itself is an obstacle because of the fixed rails. One example of this occurs in the maintenance of aircraft. Aircraft maintenance often requires mechanics to access parts of the aircraft that cannot be accessed from within a platform. These surfaces are the top of the fuselage and the horizontal wing surfaces. See FIGS. 1–3.

Current aerial work platforms constrain the operator to work inside a guard rail structure. These aerial lifts have platforms with many shapes and many sizes, but all constrain the operator to stay within the rails of the platform. Current fall arrest systems are attached to fixed structures such as building trusses and beams or self-supporting fixed structures, and because of this, these systems do not position the operator. The operator must then gain access to an elevated surface by some other means (such as climbing a ladder or scaffolding) and then attach to the fall arrest system. A range of solutions is available for fall protection that are so-called "fall restraint" systems and not fall arrest systems. Fall arrest systems are designed to safely catch a person that is falling. A fall restraint system is designed to limit the movement of a person so that they cannot encounter a fall. The fall restraint system does not protect or catch a person that is falling. That is, a fall restraint system consists of the equipment used to keep an employee from reaching a fall point, such as the edge of a roof or the edge of an elevated working surface. The most commonly utilized fall restraint system is a standard guardrail. A tie off system that "restrains" the employee from falling off an elevated working surface is another type of fall restraint.

In contrast, according to the definition in the Federal OSHA standard, a personal fall arrest system means a system used to arrest an employee in a fall from a working level. It consists of an anchor point, connectors, a body belt or body harness and may include a lanyard, deceleration device, lifeline, or suitable combinations of these. The entire system must be capable of withstanding the tremendous impact forces involved in stopping or arresting the fall. The forces increase with the fall distance due to acceleration. Federal OSHA standards govern structural requirements of fall arrest systems.

Many solutions for accessing elevated surfaces are available but none have the combination of providing access with a rotating telescoping boom and uninterrupted fall protection inside and outside the platform. For example, a fixed structure may be used to access elevated surfaces, and the fall arrest system can be attached to this structure. Examples are general scaffolding and structures similar to scaffolding which are specialized for certain applications. These fixed structures, however, do not provide flexible access and do not provide fall protection while accessing the work area.

Sometimes specialized structures are used for accessing aircraft. These structures conform to the shape of the airplane and have some limited flexibility to adjust for changing aircraft shape. These structures do not offer fall protection, but rather only fall restraint.

Self-retracting lifelines can be used as part of a fall arrest system by suspending them from a fixed point. These reels can be suspended from ceiling trusses, cranes, and fixed structures. Mobile structures are also used but they are fixed in shape and difficult to position.

Platforms are available that have side rails extending beyond the floor of the platform. The rails can then be located over a surface and the worker can walk on the surface with the rails surrounding him. The worker is protected from falling by the rails. This is a fall restraint system, however, and not a fall arrest system. In order for these platforms to be effective, the surface must be nearly flat to prevent a worker from sliding between the bottom of the railing and the work surface. Also, the worker cannot exit the rail perimeter. See, for example, FIGS. 4 and 5.

BRIEF SUMMARY OF THE INVENTION

In an exemplary embodiment of the invention, a fall arrest platform includes a platform cooperable with a lifting vehicle and a fall arrest system. The platform includes a floor, safety rails surrounding a perimeter of the floor, and an entrance gate in the side rails. The fall arrest system is integrated with the platform and includes a lanyard securable at one end to a user's harness, a lanyard connection securably receiving an opposite end of the lanyard, and mounting structure secured to the platform that supports the lanyard connection. The mounting structure movably supports the lanyard connection such that the user can move about a periphery of the platform.

In one embodiment, the mounting structure includes a wire rope secured about the safety rails, where the lanyard connection is movably mounted to the wire rope. Alternatively, the mounting structure may include a vertically mounted jib arm secured to the platform and extending above the user, wherein the jib arm supports the lanyard connection. In this context, the lanyard connection and the lanyard may comprise a housing and a self-retracting line disposed in the housing.

The entrance gate preferably includes a pivoting gate bar and a corresponding gate latch such that the user can attach the lanyard before entering the platform.

The platform may additionally include a compressed air accessory for power tools, the compressed air accessory including a compressed air hose mountable to the lifting vehicle and coupleable with either an onboard compressor or an external source of compressed air. Additionally, a power source for the compressed air accessory includes either an onboard engine-driven generator or an external AC power outlet.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
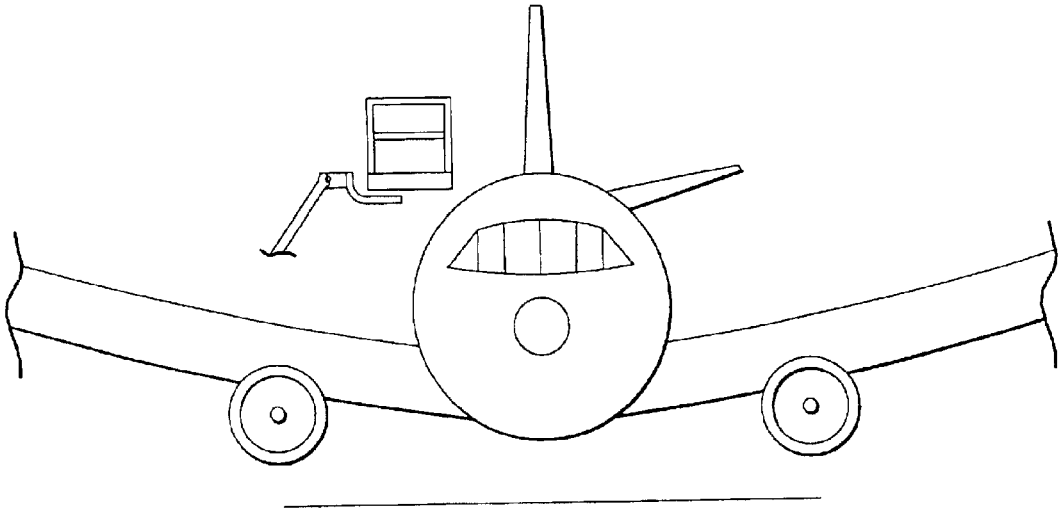
FIGS. 1–3 show exemplary uses for the fall arrest platform according to the present invention.
Figure 2:
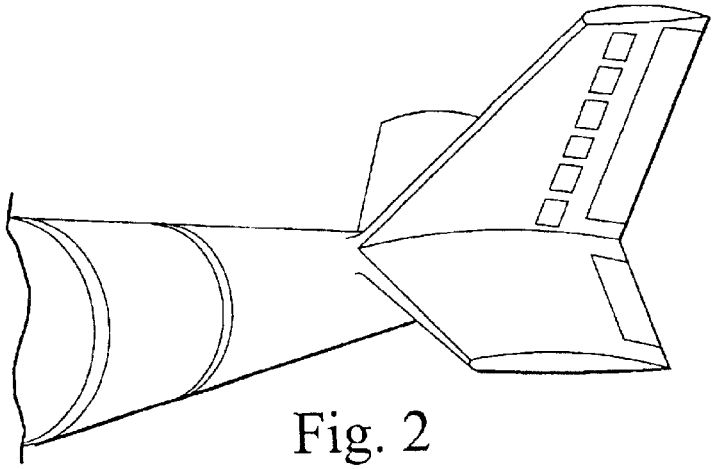
Figure 3:
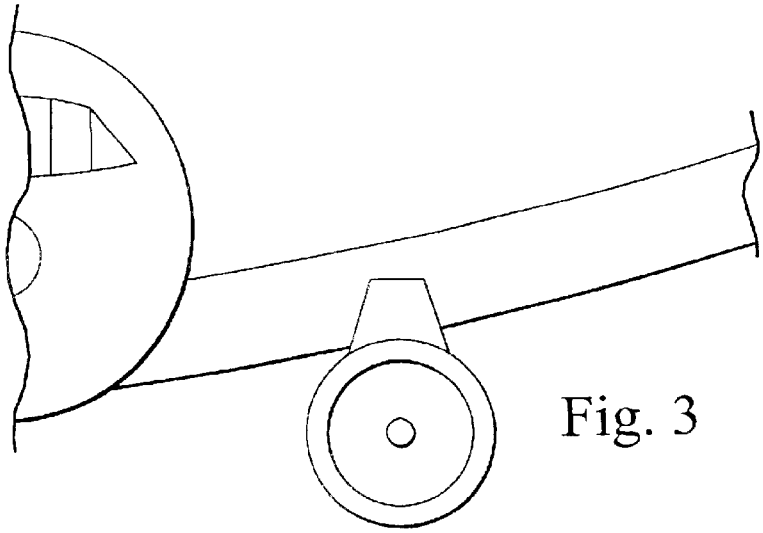
Figure 4:
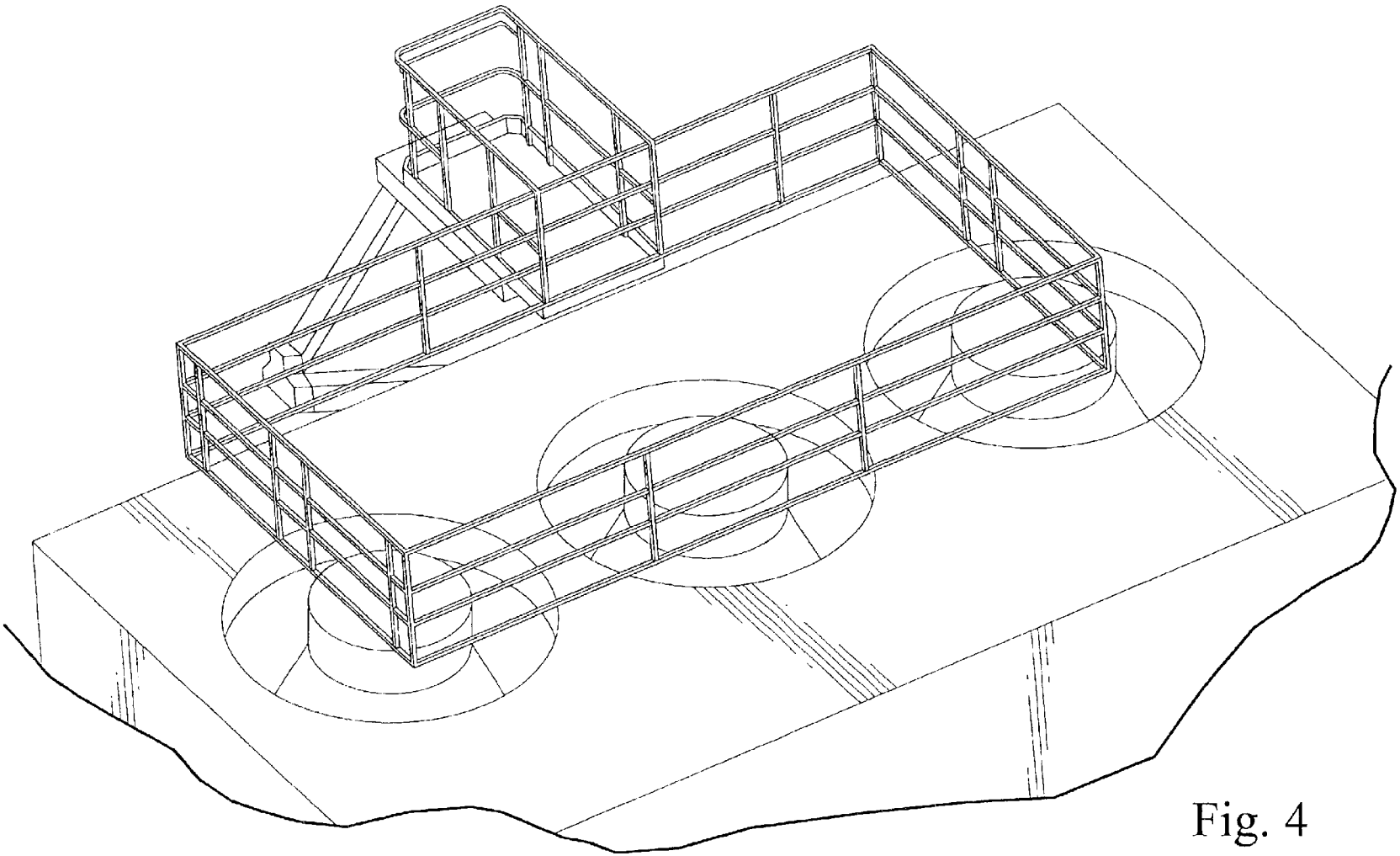
FIGS. 4 and 5 show prior art fall restraint systems including side rails that extend beyond the floor of a platform.
Figure 5:
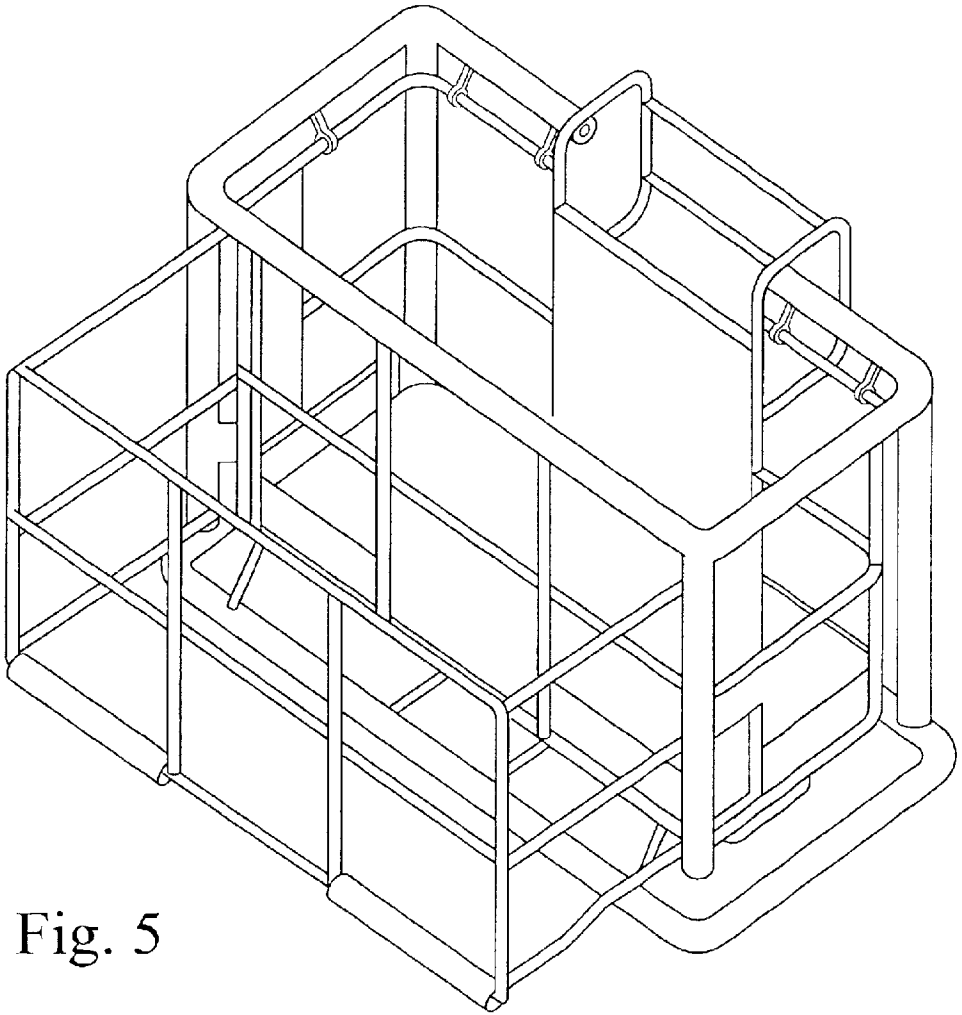
Figure 6:
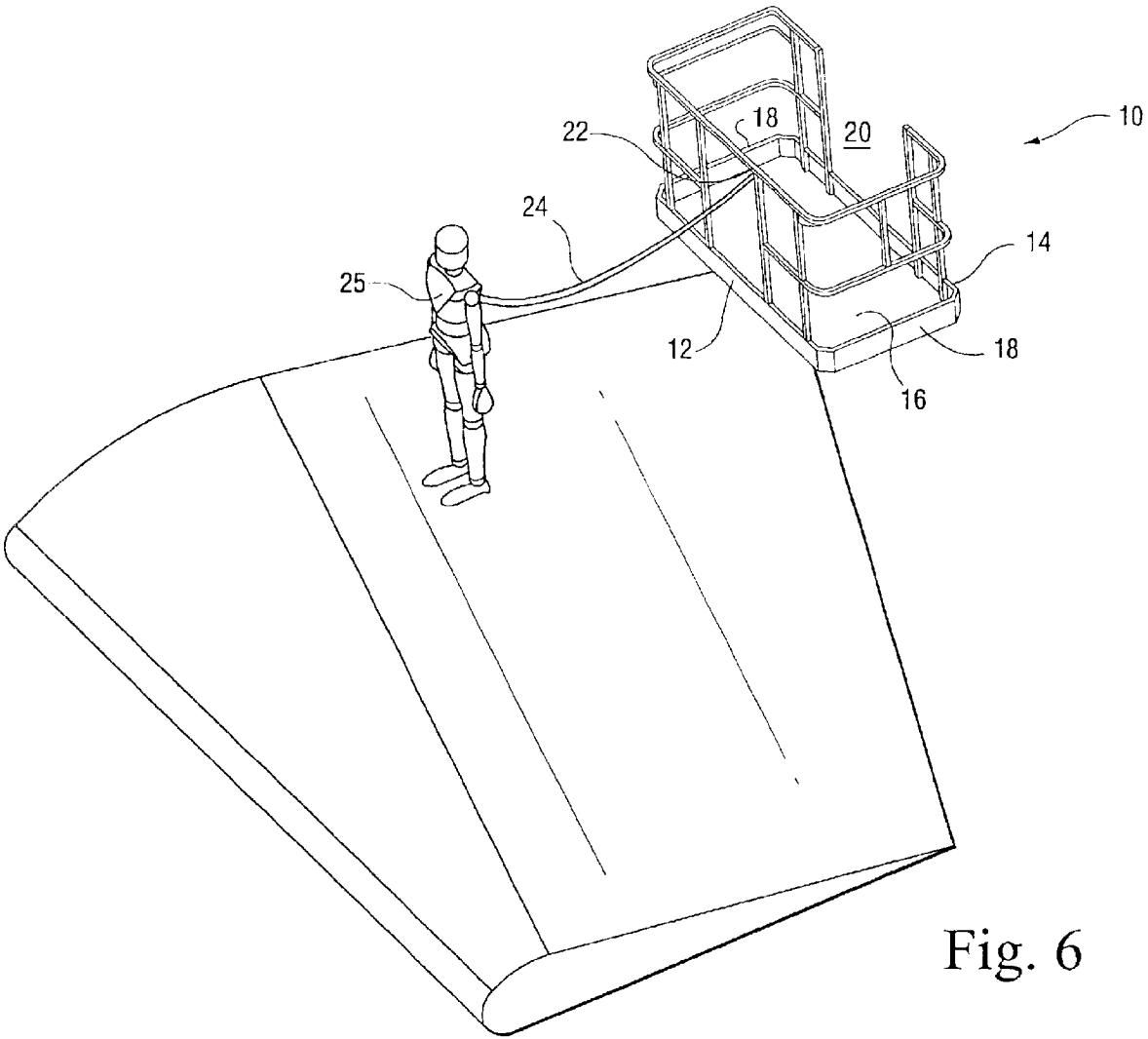
FIG. 6 is a schematic illustration of the fall arrest platform according to the present invention.

With reference to FIG. 6, a lift machine such as a boom lift, scissors lift or other lift has a platform 10 for placing workers and/or material to elevated positions and according to the present invention provides for the user to exit the platform. This platform has a front 12, back 14, floor 16, two sides 18, and an entrance gate 20. The platform has an attachment point 22 for securing one end of a suitable fall arresting lanyard 24. An opposite end of the lanyard 24 is securable to an operator's harness 25. The attachment point or lanyard connection 22 is movably connected to the top edge of the platform providing a work area equal to a shape of constant radius extending out from the platform edge. This radius is preferably equal to the length of the lanyard 24.

Figure 7:
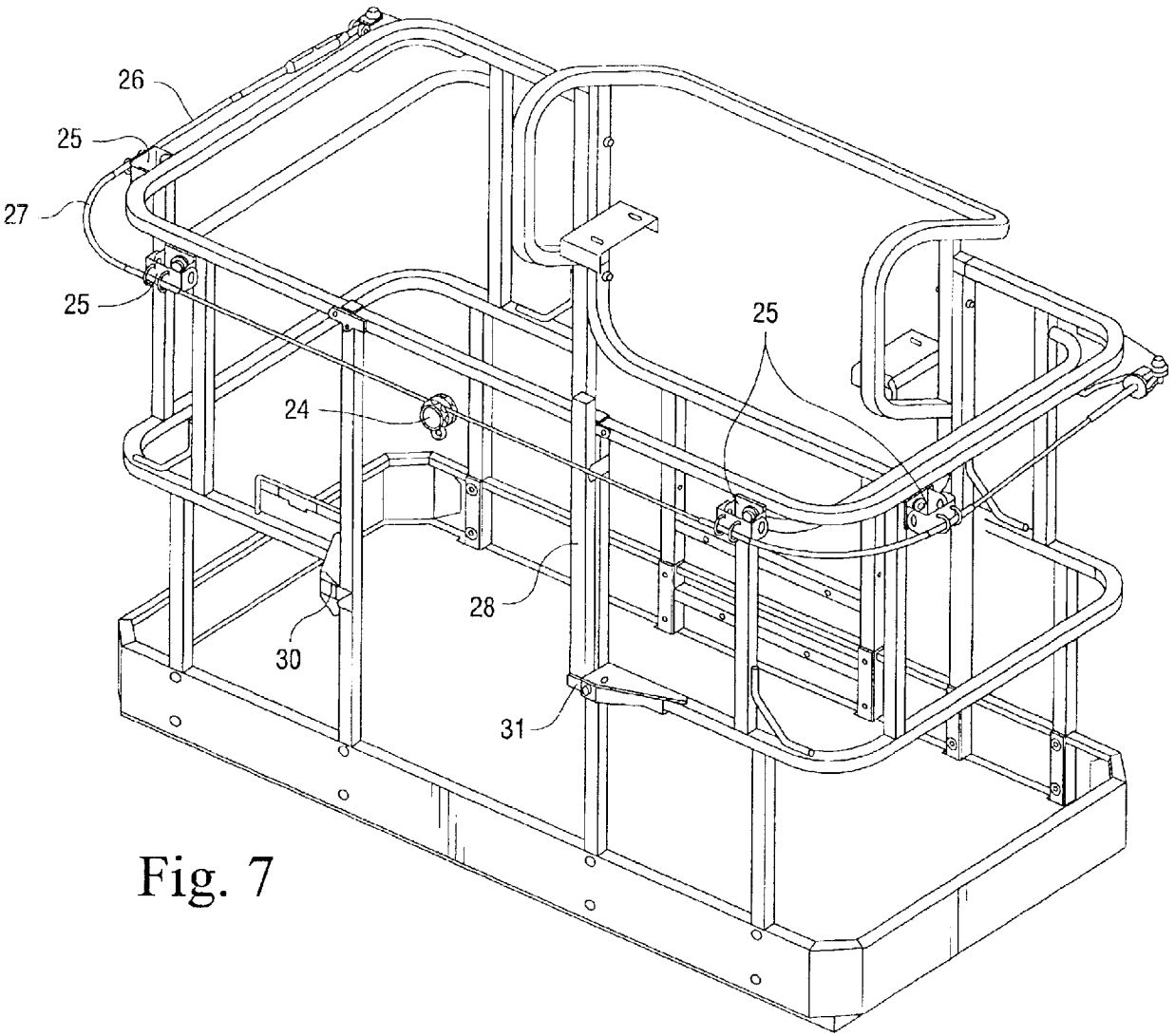
FIG. 7 illustrates additional details of the fall arrest platform of the present invention.

As shown in FIG. 7, the fall arrest system comprises stainless steel wire rope 26 with bolted attachment points, tubular sections to go around corners, and the movable lanyard connection 22. The lanyard connection is adapted to translate in a horizontal direction along the steel wire rope 26 attached to the outside edge of the platform. The steel wire rope 26 is connected to the platform structure by brackets 25 that contain tubular elements 27 that support the wire rope 26 but allow it to slide in order to equalize tension in the wire rope 26. The brackets 25 are secured to the platform with a single bolt or the like including bolted end connections. Four brackets 25 and the end connections are used to attach the cable. The stainless steel wire rope 26 and lanyard connection 22 are known, such as from the Mansafe product available from Latchways Co. The lanyard connection 22 is of the required strength that it meets requirements for fall arrest devices and generally is capable of withstanding the forces generated from arresting a falling person.

The machine itself is operated from the platform 10 where a control station is located. This control station allows the operator to drive and control all boom movement in order to be positioned at the required location. The operator can then exit the platform 10 and perform work with no platform rails to limit access. This machine will be useful any time there is a need to access an elevated surface and exit from the platform.

An entry gate to the platform includes a pivoted gate bar 28 and a gate latch 30. An important goal of the design is to allow the operator to attach the lanyard 24 before entering the platform 10 and stay attached during the entry and stay inside the platform. As a result, the machine provides continuous protection (e.g., without interruption when the worker gets on the working surface outside of the platform and has to relocate the lanyard 24 to another attachment point).

Conventional swing gates or vertical sliding bars may present a danger of the lanyard 24 being tangled under the gate mechanism and restricting operator movement when working from the platform. That is, the lanyard 24 is attached on the outside of the platform. The operator then enters the platform, whereupon the lanyard 24 is passing through the gate opening. With a drop bar gate, the gate will rest on the lanyard 24, and if the lanyard 24 is tensioned, it will lift the gate bar 28. A swing gate, which is constructed like a door, will allow the lanyard 24 to pass through, but is susceptible to tangling the lanyard 24 and requires special attention from the operator to keep the lanyard 24 free from the gate components. An offset pivot point 31 makes the gate bar self-closing.

Figure 8:
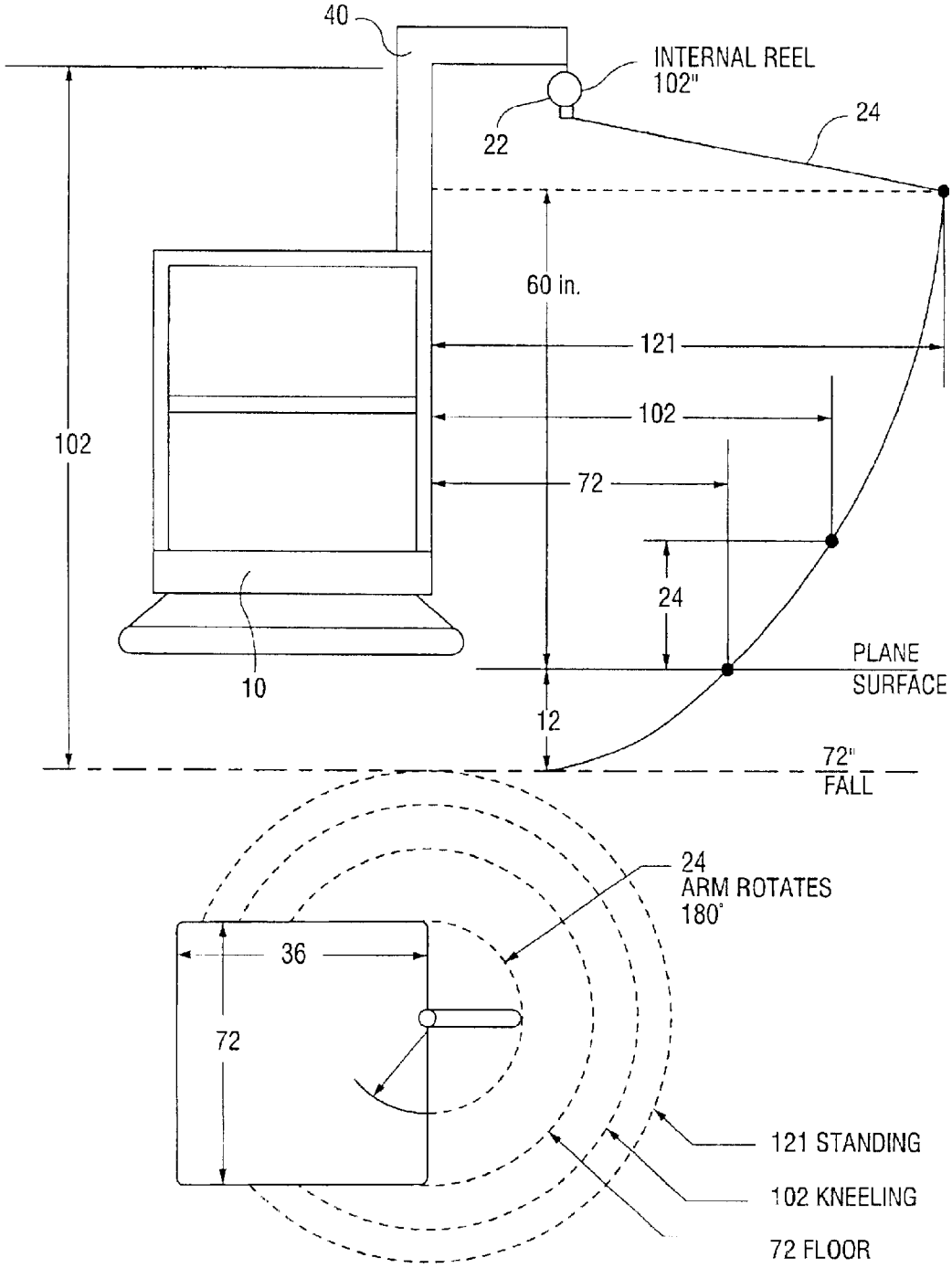
FIG. 8 illustrates an alternative embodiment of the fall arrest platform of the present invention.

An alternative embodiment of the fall arrest system according to the present invention is shown in FIG. 8. The platform includes a vertical pivotally mounted jib arm 40 extending out from the platform 10 and above the worker. This arm 40 carries the attachment point 22 for the fall arrest system. The worker is attached to the jib arm with a fixed lanyard 24. A self-retracting lifeline may be attached to the jib arm 40 in place of the fixed lanyard 24. This will allow greater movement in the vertical direction of the worker.

Figure 9:
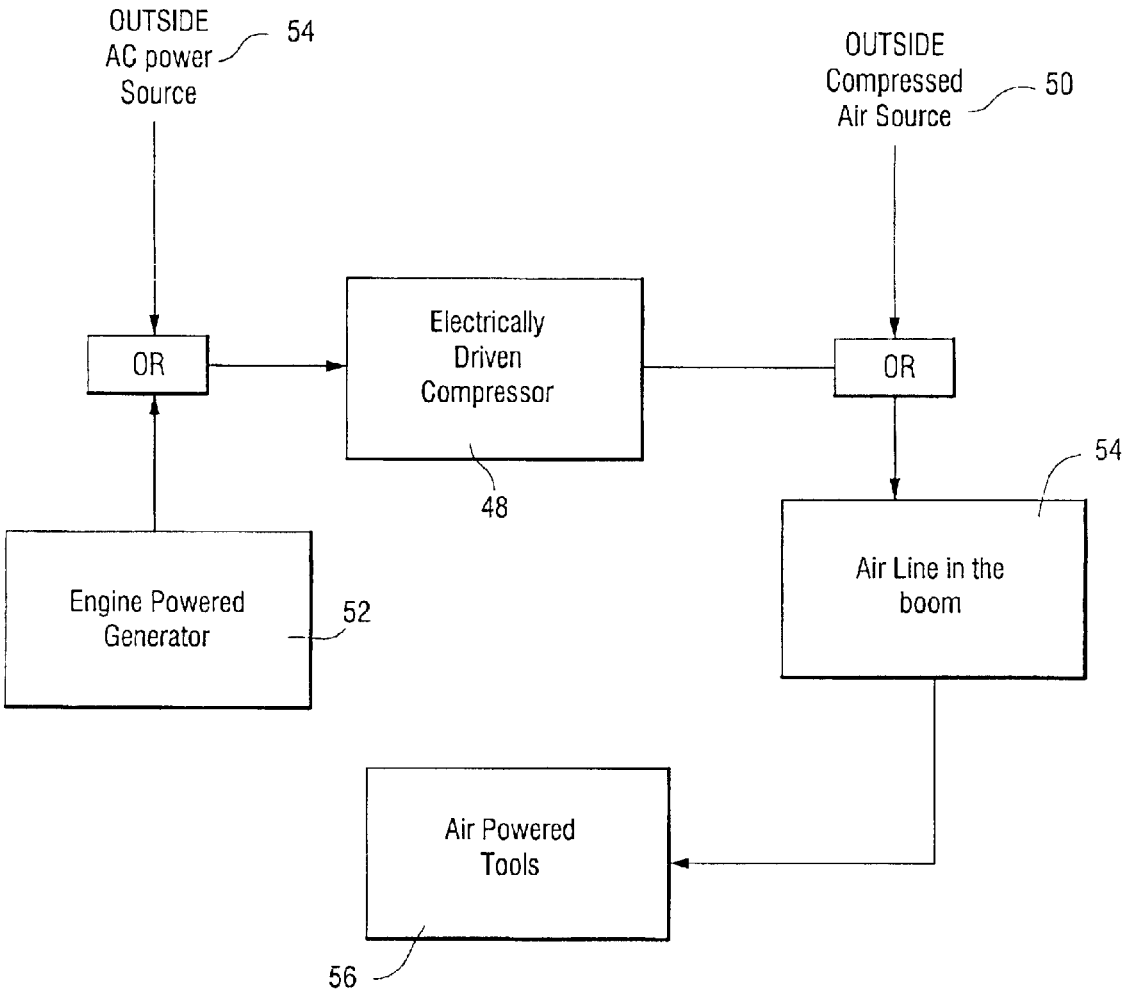
FIG. 9 is a schematic block diagram of a compressed air accessory forming part of the fall arrest platform of the present invention.

With reference to FIG. 9, an accessory providing compressed air to power tools may be included with the fall arrest system. The flexible design provides multiple energy power sources for air powered tools 56. A compressed air hose 54 permanently installed inside the boom supplies compressed air to the tools. The source of compressed air can be an onboard compressor 48 or (using a quick coupler) an outside compressed air source 50 (for example permanent air distribution system as installed in some industrial facilities). Additional flexibility is provided by the choice of power for the air compressor. It can be powered either from an onboard engine driven generator 52, or from an outside AC power outlet 54—for example, a building's electrical system (if the machine is used indoor and running the engine to power tools is not acceptable).

With the fall arrest platform according to the present invention, a lift machine with the ability to access elevated surfaces can also enable a safe work area outside of the machine platform. A compressed air accessory provides additional functionality and convenience.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fall arrest platform comprising:

a platform cooperable with a lifting vehicle, the platform including a floor, safety rails surrounding a perimeter of the floor, and an entrance gate in the side rails; and a fall arrest system integrated with the platform, the fall arrest system including a lanyard securable at one end to a user's harness, a lanyard connection securably receiving an opposite end of the lanyard, and mounting structure separate from the safety rails secured to the platform that supports the lanyard connection, wherein the mounting structure movably supports the lanyard connection such that the user can move about a periphery of the platform.

2. A fall arrest platform according to claim 1, wherein the mounting structure comprises a wire rope secured about the safety rails, the lanyard connection being movably mounted to the wire rope.

3. A fall arrest platform according to claim 1, wherein the entrance gate comprises a pivoting gate bar and a corresponding gate latch such that the user can attach the lanyard before entering the platform.

4. A fall arrest platform according to claim 1, further comprising:

a compressed air accessory for power tools, the compressed air accessory including a compressed air hose mountable to the lifting vehicle and coupleable with either an onboard compressor or an external source of compressed air; and a power source for the compressed air accessory including either an onboard engine-driven generator or an external AC power outlet.

5. A fall arrest platform comprising:

a platform cooperable with a lifting vehicle, the platform including a floor, safety rails surrounding a perimeter of the floor, and an entrance gate in the side rails; and a fall arrest system integrated with the platform, the fall arrest system including a lanyard securable at one end to a user's harness, a lanyard, connection securably receiving an opposite end of the lanyard, and mounting structure secured to the platform that supports the lanyard connection, wherein the mounting structure movably supports the lanyard connection such that the user can move about a periphery of the platform, wherein the mounting structure comprises a vertically mounted jib arm secured to the platform and extending above the user, and wherein the jib arm supports the lanyard connection.

6. A fall arrest platform according to claim 5, wherein the lanyard connection and the lanyard comprise a housing and a self-retracting line disposed in the housing.

7. A fall arrest platform system comprising:

a lifting vehicle;

a platform cooperable with the lifting vehicle, the platform including a floor, safety rails surrounding a perimeter of the floor, and an entrance gate in the side rails;

a fall arrest system integrated with the platform, the fall arrest system including a lanyard securable at one end to a user's harness, a lanyard connection securably receiving an opposite end of the lanyard, and mounting structure secured to the platform that supports the lanyard connection, wherein the mounting structure movably supports the lanyard connection such that the user can move about an entire periphery of the platform;

a compressed air accessory for power tools, the compressed air accessory including a compressed air hose mounted to the lifting vehicle and coupled with a source of compressed air; and a power source for the compressed air accessory.

8. A fall arrest platform system according to claim 7, wherein the mounting structure comprises a wire rope secured about the safety rails, the lanyard connection being movably mounted to the wire rope.

9. A fall arrest platform system according to claim 7, wherein the mounting structure comprises a vertically mounted jib arm secured to the platform and extending above the user, and wherein the jib arm supports the lanyard connection.

10. A fall arrest platform system according to claim 9, wherein the lanyard connection and the lanyard comprise a housing and a self-retracting line disposed in the housing.

11. A fall arrest platform system according to claim 7, wherein the entrance gate comprises a pivoting gate bar and a corresponding gate latch such that the user can attach the lanyard before entering the platform.

* * * * *